United States Patent [19]

Shima et al.

[11] Patent Number: 4,931,317

[45] Date of Patent: Jun. 5, 1990

[54] COMPOSITION AND PROCESS FOR THE FORMATION OF A BLACK COATING ON SURFACES OF MATERIALS

[75] Inventors: Shizuo Shima; Soei Koizumi, both of Kanagawa, Japan

[73] Assignee: Nihon Parkerizing Co., Ltd., Tokyo, Japan

[21] Appl. No.: 330,557

[22] Filed: Mar. 30, 1989

[30] Foreign Application Priority Data

Mar. 30, 1988 [JP] Japan ..... 63-74671

[51] Int. Cl.[5] ..... B05D 3/02

[52] U.S. Cl. ..... 427/385.5; 427/388.4; 427/389.7; 524/430; 524/431; 524/435

[58] Field of Search ..... 427/385.5, 388.4, 389.7, 427/435; 524/430, 431, 435

[56] References Cited

U.S. PATENT DOCUMENTS 4,347,172 8/1952 Nishida et al. ..... 524/431 X 4,636,264 1/1987 Schellenberg et al. ..... 427/435 X

FOREIGN PATENT DOCUMENTS 56-33155 4/1981 Japan .

*Primary Examiner*—Michael Lusignan

*Attorney, Agent, or Firm*—Ernest G. Szoke; Wayne C. Jaeschke; Norvell E. Wisdom, Jr.

[57] ABSTRACT

A deeply and uniformly black coating with excellent adhesion and corrosion resistance can be formed on a wide variety of substrates by coating them with an aqueous composition containing an amount of chromium trioxide to give a stoichiometric equivalent of from about 30 to about 150 g/L of $Cr^{6+}$; from about 20 to about 100 g/L of $Cr^{3+}$; a component to provide a stoichiometrically equivalent amount of from about 0.5 to about 50 g/L of total Fe, Co, and Ni ions; from about 5 to about 200 g/L of dispersed or dissolved organic film forming polymer; and the balance water, with a weight ratio of $Cr^{a6}$ to Cr+3 between about 5 and about 1; and heating the coated substrate to a temperature between 100° and 350° C. for 5 seconds to 10 minutes.

20 Claims, No Drawings

COMPOSITION AND PROCESS FOR THE FORMATION OF A BLACK COATING ON SURFACES OF MATERIALS

FIELD OF THE INVENTION

The present invention relates to a method and composition for the formation of a black film or coating on the surfaces of various materials, and particularly of various metals, such as ferrous metals including stainless steels, zinc and its alloys, aluminum and its alloys, and copper and its alloys, including materials with surfaces of these metals produced by plating, as well as surfaces of other inorganic substances such as ceramics and glasses. Along with many other applications readily conceivable to those skilled in the art, the process of the invention is useful for blackening treatments in which a design may be required, as in optical devices, electrical devices, electronic components, construction materials, and the like; for blackening treatments for the formation of heat-absorbing surfaces such as solar-energy collector materials and the like; and for blackening treatments for the formation heat-radiating surfaces such as engine blocks and the like.

STATEMENT OF RELATED ART

Methods for the formation of black films or coatings on the surfaces of various metals (e.g., ferrous metals, stainless steels, zinc and its alloys, aluminum and its alloys, copper and its alloys) are currently available, although these vary with the particular type of metal. The composition of the treatment solution and the treatment conditions vary from case to case. As a consequence, when seeking to blacken metal surfaces, a surface-treatment service center, which may handle many different types of metals, must prepare different treatment agents, treatment equipment, etc., for each type of metal. Another problem is that the black color varies with the type of metal.

Known methods for blackening the surfaces of inorganic materials (glasses, ceramics, etc.) include methods in which a liquid resin containing a black dye and/or black pigment is coated on and then baked on the material, and methods in which the inorganic material is coated with a conductive material followed by plating a metal or alloy under conditions that give a black surface. The former methods suffer from the following problems: the film thickness must be at least 10 micrometers, and film adhesion is often unsatisfactory. The latter methods are inefficient, and it is also difficult when using such methods to obtain a satisfactory blackness. As a consequence, substantial demand has arisen for the improvement of methods for black film formation in which a surface treatment solution is coated and baked onto the material surface.

Japanese Patent Publication No. 56-33155 [33,155/81]in the name of Nihon Parkerizing Co., Ltd., titled "Method for the formation of a black coating on the surface of aluminum and aluminum alloys", teaches a method for the formation of a black coating on the surface of aluminum and aluminum alloys by coating an aqueous solution, which contains a hexavalent chromium compound, reductant, and water-soluble resin, onto the surface of aluminum or an aluminum alloy, followed by baking to produce a coating with a mass of 2.5–5 grams per square meter of surface (g/m$^2$). However, it has been found that a satisfactory blackness cannot generally be obtained when this technology is applied to the surfaces of various substrates other than aluminum and its alloys; either a black but non-uniform film or a dark brown rather than a black film is formed.

The present invention has as a major object to solve the problems noted in the prior art, by the formation of a black film which has both excellent adhesion and uniformity and which imparts a desirable luster or gloss to the surfaces of many different substrate materials.

DESCRIPTION OF THE INVENTION

Throughout this description, except in the operating examples or where otherwise explicitly indicated, all numbers specifying quantities of materials or conditions of reaction or use are to be understood as modified by the word "about".

It has been found that a black surface film can be formed not only on aluminum materials, but also on a wide variety of other materials by coating and subsequently baking a treatment solution containing ferrous metal ions (i.e., iron, cobalt, and/or nickel ions), hexavalent chromium, trivalent chromium, and a film forming polymer dissolved or dispersed in water. More specifically, the composition of the treating solution according to this invention should lie within the following limits:

| | |
|---|---|
| Chromium trioxide to give a stoichiometric equivalent of $Cr^{6+}$ of: | 30–150 g/L |
| $Cr^{3+}$: | 20–100 g/L |
| Weight ratio of $Cr^{6+}/Cr^{3+}$: | 5–1 |
| A component stoichiometrically equivalent to a total content of Fe, Co, and Ni ions of: | 0.5–50 g/L |
| Solids content of organic polymer: | 5–200 g/L |

The reasons for the limits given above, to the extent that they are now understood by the applicants, are set forth below, but are not to be regarded as limiting the invention, except to the extent that the limits are incorporated into the appended claims.

The $Cr^{+6}$ concentration should be within the range given above, and is more preferably between 50 and 120 grams per liter (g/L). Blackening becomes unsatisfactory and a brown film is more readily formed when the $Cr^{6+}$ concentration falls below 30 g/L, while a risk of gelation of the organic polymer resin content of the solution arises when the equivalent concentration of $Cr^{+6}$ exceeds 150 g/L.

The $Cr^{3+}$ concentration is to be 20–100 g/L, and preferably is 30–80 g/L. Furthermore, the $Cr^{3+}$ concentration is determined relative to the $Cr^{6+}$ concentration by the chromium ratio given above. When the chromium ratio exceeds 5/1, the resin in the aqueous treatment solution readily tends to gel. The result is a substantial decline in the performance of the film coating. On the other hand, when the chromium ratio falls below 1/1, chromium readily precipitates, and the film formed from such a treatment solution is poorly adhesive.

In order to bring the chromium concentrations within the ranges specified above, it is preferred to dissolve a suitable quantity of chromic anhydride in a specified quantity of water, and then to adjust and maintain the chromium ratio in the treatment solution by addition of a suitable quantity of a reductant, preferably an organic reductant selected from monohydric alcohols (for example, methanol, ethanol), dihydric alcohols (for example, ethylene glycol, polyethylene glycol), and carboxylic acids with at least two carboxyl groups (for example, oxalic acid, citric acid, succinic acid, etc.). These organic reductants are oxidized predominantly to carbon dioxide and water, but small amounts of other products such as formic acid or acetic acid may be formed as well.

Instead of reducing part of the initial $Cr^{+6}$ content of the solution, a $Cr^{+3}$ salt may be added to the solution directly.

The compounds of Fe, Co, and/or Ni to be added to the aqueous treatment solution preferably are selected from the hydroxides, carbonates, and nitrates of these ferrous metals. Here, the atomic valence of the added metal is not crucial; for example, in the case of iron compounds, divalent and trivalent compounds can both be used. These compounds are to be added within the range, as metal ion, of 0.5–50 g/L and preferably 2–40 g/L. When the quantity of addition of these compounds falls below 2 g/L, the black film formed by coating and baking the aqueous treatment solution will usually have a poor uniformity. On the other hand, the beneficial effect from these ferrous metal compounds is not increased by addition beyond 50 g/L, while the cost of the treatment solution is raised.

The organic polymer content of the aqueous treatment solution of the present invention is preferably an emulsified acrylic, vinyl acetate, styrene, or phenolic polymer that forms a coherent film on drying and/or baking, and acrylic polymers are most preferred. This polymer is to be present at 5–200 g/L as solids, and preferably at 10–150 g/L as solids. When less than 5 g/L of polymer is present, the black film obtained has reduced adhesion and reduced corrosion resistance when coated on metals, and the external appearance is also worsened because the film has reduced luster or gloss. On the other hand, when more than 200 g/L of polymer is present, blackening is inhibited and a brown coat tends to be formed rather readily instead. Furthermore, the heat resistance of the coating is also reduced. In addition to the polymer as described above, an emulsifying agent will be present in an organic polymer emulsion. This emulsifying agent not only functions to maintain and support the dispersibility of the particular polymer, but also serves to suppress gelation of the polymer in the aqueous treatment solution. Thus the emulsifying agent contributes to a uniform coatability on the part of the aqueous treatment solution, and therefore to a modest degree indirectly supports uniform blackening.

The aqueous treatment solution of the present invention preferably should be stored in the cool and dark; even so, however, the polymer in this treatment solution does have a tendency to gel during long-term storage. This gelation is influenced by the type of polymer, the $Cr^{6+}$ concentration, the chromium ratio, and the liquid temperature. Quality control of the solution is important, in order to use it prior to the development of gelation.

The aqueous treatment solution of the present invention is to be coated and baked onto a clean surface of the material. Suitable cleaning means include vapor cleaning by trichloroethylene or an alkali wash, but are not limited to these methods. The material to be coated and blackened is not specifically restricted in the present invention, and it may be any material which is sufficiently heat resistant to withstand the baking process, infra. Blackening can be carried out on the surfaces of metals such as stainless steels, aluminum and its alloys, zinc and its alloys, copper and its alloys, etc.; nonmetallic or metallic substrates which have been variously plated and/or conversion treated on their surfaces prior to the blackening treatment of this invention; and on inorganic materials such as ceramics, glasses, etc.

With regard to the coating method, roll coating, immersion or dipping, and spray methods may be selected without restriction; the essential element here is simply that the treatment solution uniformly covers the part of the surface of the substrate to be blackened before baking begins. During coating it will generally be preferable to use a procedure for removing excess solution by some means such as an air blower, air knife, squeezing, or the like.

After coating, the coated substrate is rapidly heated or baked. Baking is preferably conducted in an oven at an internal temperature of 100°–350° C for 5 seconds to 10 minutes. These conditions will vary with the type, shape, and thickness of the material, with the add-on mass of the coating, and with the concentration of polymer in the aqueous treatment solution, and should be determined on a trial basis beforehand. The film add-on mass obtained after baking is not critical, but preferably falls within the range of 2.5–10 $g/m^2$ or a thickness of 0.5 to 4 microns. Accordingly, it is best to determine the advantageous range for film add-on by reference to the intended use of the material after the black coating is formed on it.

Baking conditions are selected in order to accomplish two objectives: adhesion to the surface of the material and blackening. Under baking conditions that are too mild, the film will be incompletely blackened and will have a reduced adhesiveness, along with a reduced corrosion resistance when applied on metals. On the other hand, problems with discoloration appear when the baking temperature becomes appreciably higher than 350° C. When a black coating formed by the method of the present invention is exposed to an air temperature of 300° C for about 1 hour, no discoloration occurs. However, greenish discoloration can occur at 500° C after 1 hour, and such high-temperature baking should therefore be avoided.

The present invention provides a novel film or coating, characterized by a black color and a composition essentially of compounds of mainly trivalent chromium; compounds of metal(s) selected from Fe, Co, and Ni; and an organic polymer.

According to the method of the present invention, this black film is produced by using an aqueous treatment solution having three groups of essential components: chromium at a specified $Cr^{6+}/Cr^{3+}$ ratio; a compound of at least one species of metal selected from Fe, Co, and Ni; and an organic polymer. This aqueous treatment solution is applied on the surface of the material and the coated film then baked. When such an aqueous treatment solution does not contain metal ion selected from Fe, Co, and Ni, the film obtained after coating and baking is nonuniform and dark brown in part. However, when such a treatment solution contains a metal compound selected from compounds of Fe, Co, and Ni, it is conjectured that during baking the $Cr^{6+}$ predominantly becomes $Cr^{+3}$ by means of chemical reaction with the substrate and/or chemical reaction with the organic polymer. Moreover, with regard to the metal atoms selected from Fe, Co, and Ni, it is thought that a complex crosslink-bonded matrix is formed by reaction mechanisms which include the polymer and trivalent chromium, and that the steric structure of this crosslink-bonded matrix causes a uniform and deep black color. However, the color development mechanism has yet to be elucidated in detail.

The practice of the present invention may be further appreciated from the following operating examples.

EXAMPLES

1. Method of Preparation of the Aqueous Treatment Solution (1) The Chromium-Containing Solution An appropriate amount of $CrO_3$ powder or of a concentrated solution of $CrO_3$ was dissolved in an appropriate amount of water. About 20 volume % aqueous ethanol was then added to the $CrO_3$ solution to reduce an appropriate fraction of the $CrO_3$ content to $Cr^{+3}$. Into this solution with a proper chromium ratio, a suitable amount of a compound of Fe, Co, or Ni is then dissolved.

(2) Black-Treatment Solution

The solution prepared in part (1) was mixed with an appropriate amount of water-borne polymer, a 30% solids acrylic polymer emulsion with non-ionic emulsifying agent sold by Hoechst of Japan, and the final mixture was adjusted with water to a volume that gave the desired concentrations of all components.

The compositions of aqueous treatment solutions prepared by this method for the Examples are reported in Table 1.

TABLE 1

| treatment | Examples of the Present Invention | | | | | Comparison Examples | | | | | |
|---|---|---|---|---|---|---|---|---|---|---|---|
| solution no. | 1 | 2 | 3 | 4 | 5 | 6 | 7 | 8 | 9 | 10 | 11 |
| $Cr^{6+}$ (g/L) | 150 | 100 | 80 | 40 | 70 | 150 | 100 | 80 | 100 | 200 | 20 |
| $Cr^{3+}$ (g/L) | 40 | 80 | 30 | 30 | 60 | 40 | 80 | 30 | 80 | 60 | 20 |
| $Cr^{6+}/Cr^{3+}$ ratio | 3.8 | 1.3 | 2.7 | 1.3 | 1.2 | 3.8 | 1.3 | 2.7 | 1.3 | 3.3 | 1 |
| additive | $Ni^{2+}$ | $Ni^{2+}$ | $Co^{2+}$ | $Fe^{3+}$ | $Fe^{2+}$ | — | — | $Ni^{2+}$ | $Ni^{2+}$ | $Co^{2+}$ | $Fe^{3+}$ |
| (g/L) | 5 | 40 | 20 | 10 | 1 | | | 40 | 40 | 10 | 10 |
| emulsion (g/L) | 10 | 50 | 150 | 30 | 80 | — | 10 | — | 250 | 30 | 10 |

TABLE 2

| | conditions | material treated | coating solution number | external appearance blackness | external appearance uniformity | discoloration | heat resistance | corrosion resistance | bonding |
|---|---|---|---|---|---|---|---|---|---|
| the present invention | (1) | aluminum | 1 | ++ | ++ | ++ | ++ | 336 | 100 |
| | (2) | iron | 2 | ++ | ++ | ++ | ++ | 72 | 100 |
| | (3) | copper | 3 | ++ | ++ | ++ | ++ | 500 | 100 |
| | (4) | stainless | 4 | ++ | ++ | ++ | ++ | — | 100 |
| | (5) | Zn plate | 5 | ++ | ++ | ++ | ++ | 72 | 100 |
| | (6) | glass | 1 | ++ | ++ | ++ | ++ | — | 100 |
| comparison examples | (7) | aluminum | 6 | ++ | × | × | D | 96 | 75 |
| | (8) | iron | 7 | ++ | ++ | ++ | D | 3 | 100 |
| | (9) | copper | 8 | ++ | D | × | ++ | 336 | 84 |
| | (10) | stainless | 9 | D | ++ | ++ | ++ | — | 100 |
| | (11) | Zn plate | 10 | ++ | D | ++ | ++ | 48 | 100 |
| | (12) | glass | 11 | × | ++ | ++ | ++ | — | 100 |

(2) Substrate Materials aluminum: A1100
iron: ASTM Type A 366
stainless: Type 304
copper: 99% pure electric copper
zinc plating: zinc-electroplated steel plate
glass: heat-resistant glass (3) Surface Cleaning Procedure (A) When no rust was present
(1) vapor cleaning with trichloroethylene or the like
(2) degreasing with alkali, then water wash
(3) polish with shot or the like (except for glass)
(B) When rust was present
(1) vapor cleaning with trichloroethylene or the like, then acid rinse (nitric acid, sulfuric acid, or the like), then water rinse
(2) degreasing with alkali, then water rinse, then acid rinse, then water rinse
(3) polish with shot or the like, then acid rinse, then water rinse (4) Coating and Baking Processes The black-treatment solution was applied by dipping, spraying, rolling, etc., followed by baking at 100°–350° C for 5 seconds–10 minutes.

Average film thickness =2.4 microns. 3. Test Methods (1) External Appearance (Blackness and Uniformity)

(1) W value measured with a blackness meter

The samples were measured with a Model SM-3 color computer made by SUGA Test Instruments K.K. of Japan. The W value $=100[(100-L)^2+a^2+b^2]^{0.5}$, where L is the lucidity and a and b are chromatic indices. The lower the W value, the more nearly absolutely black is the sample. Values are reported in the table as ranges as follows:

| | |
|---|---|
| <15 = black | ++ |
| ≧15, but <20 = black-brown | D |
| ≧20 = yellow-brown | – |

(2) Uniformity

Standard Deviation of the W. Value from 5 Measurements

| | |
|---|---|
| <3 = uniform | ++ |
| ≧3, but <5 = slightly nonuniform | D |

-continued

| | |
|---|---|
| ≧5, substantially nonuniform | – |

(2) Discoloration

Wet conditioning was conducted at 50°±1° C and a humidity of at least 95% for 72 hours, and the external appearance was then evaluated:

| | |
|---|---|
| ++ | no abnormalities |
| + | discoloration over <5% of surface area |
| D | discoloration over 5 to <20% of surface |
| – | discoloration over ≧20% of surface area |

(3) Heat Resistance

A test specimen was maintained in an oven at an oven temperature of 300° C for 1 hour, and the external appearance was then evaluated:

| | |
|---|---|
| ++ | no abnormalities |
| D | black-green with a W value (blackness) of 15-20 |
| – | black-green with a W value (blackness) of ≧20 |

(4) Corrosion Resistance

Salt-spray testing (without crosscutting) was conducted according to JIS-Z-2371, and the time period during which rust and blistering were completely absent from the external appearance was measured. Thus, the corrosion resistance is better at larger numerical values for the time. The results are reported in Table 2.

(5) Coating Adhesion

A checkerboard pattern of 100 crosscut squares (1 mm square) was constructed, and cellophane tape was applied and then peeled off. The number of remaining squares was counted, and these test results are reported in Table 2.

The present invention produces a film with a deep and uniform blackness, which also has an excellent heat resistance, corrosion resistance, and adhesion to the substrate. It is believed that because of the presence of a ferrous metal compound in the aqueous treatment solution, improved heat resistance of the film and improved corrosion resistance when the film is applied on metals are achieved.

The coating obtained by means of the present invention has excellent decorative properties. On electrical appliances with a black external appearance, which have recently been in great demand, it is fully competitive in terms of external appearance and quality with prior coloration methods.

Furthermore, because the black film produced by the method of the present invention has an excellent resistance to discoloration as well as excellent adhesion, it can provide an attractive appearance for the long term. In addition, since the method of the present invention can produce thin films, it is superior in terms of cost.

Thus the film of the present invention, with its favorable features as elucidated above, has an overall performance superior to that of prior coatings. Moreover, its excellent corrosion resistance is very useful in particular for parts to be used outdoors, such as solar-energy collectors, etc. Its excellent heat resistance is very favorable in particular for parts which are to be used at high temperatures, such as engine blocks, etc.

What is claimed is:

1. A fluid composition of matter, consisting essentially of:

(A) an amount of chromium trioxide to give a stoichiometric equivalent of from about 30 to about 150 g/L of $Cr^{6+}$;

(B) from about 20 to about 100 g/L of $Cr^{3+}$;

(C) a component to provide a stoichiometrically equivalent amount of from about 0.5 to about 50 g/L of total ferrous metal ions;

(D) from about 5 to about 200 g/L of dispersed or dissolved organic film forming polymer; and (E) the balance water, wherein the weight ratio of $Cr^{+6}$ to $Cr^{+3}$ is between about 5 and about 1.

2. A composition according to claim 1, wherein the amount of $Cr^{+6}$ is between about 50 and about 120 g/L; the amount of $Cr^{+3}$ is between about 30 and about 80 g/L; the amount of Fe+Ni+Co ions is between about 2 and about 40 g/L; and the amount of polymer solids is between about 10 and about 150 g/L.

3. A composition according to claim 2, wherein the component providing the ferrous metal content is selected from hydroxides, carbonates, and nitrates of the ferrous metals.

4. A composition according to claim 3, wherein the organic polymer content is selected from acrylic, vinyl acetate, styrene, and phenolic polymers.

5. A composition according to claim 2, wherein the organic polymer content is selected from acrylic, vinyl acetate, styrene, and phenolic polymers.

6. A composition according to claim 1, wherein the organic polymer content is selected from acrylic, vinyl acetate, styrene, and phenolic polymers.

7. A composition according to claim 6, wherein the organic polymer content consists essentially of dispersed acrylic polymer resin.

8. A composition according to claim 5, wherein the organic polymer content consists essentially of dispersed acrylic polymer resin.

9. A composition according to claim 4, wherein the organic polymer content consists essentially of dispersed acrylic polymer resin.

10. A process for forming a black surface on a solid substrate, comprising the steps of:

(A) coating the substrate surface with a film of a fluid composition consisting essentially of:

(1) an amount of chromium trioxide to give a stoichiometric equivalent of from about 30 to about 150 g/L of $Cr^{6+}$;

(2) from about 20 to about 100 g/L of $Cr^{3+}$;

(3) a component to provide a stoichiometrically equivalent amount of from about 0.5 to about 50 g/L of total ferrous metal ions;

(4) from about 5 to about 200 g/L of dispersed or dissolved organic film forming polymer; and (5) the balance water, wherein the weight ratio of to $Cr^{+6}$ to $Cr^{+3}$ is between about 5 and about 1; and (B) heating the coated substrate formed in step (A) to a sufficient temperature for a sufficient time to form an adherent uniformly black coating on the substrate.

11. A process according to claim 10, wherein, in the fluid composition used in step (A), the amount of $Cr^{+6}$ is between about 50 and about 120 g/L; the amount of $Cr^{+3}$ is between about 30 and about 80 g/L; the amount of ferrous metal ions is between about 2 and about 40 g/L; and the amount of polymer solids is between about 10 and about 150 g/L.

12. A process according to claim 11, wherein the component providing the ferrous metal ion content is selected from hydroxides, carbonates, and nitrates of the ferrous metals.

13. A process according to claim 12, wherein the organic polymer content consists essentially of dispersed acrylic polymer resin.

14. A process according to claim 11, wherein the organic polymer content consists essentially of dispersed acrylic polymer resin.

15. A process according to claim 10, wherein the organic polymer content consists essentially of dispersed acrylic polymer resin.

16. A process according to claim 10, wherein step (B) is performed for about 5 seconds to about 10 minutes in an oven at an internal oven temperature of about 100° to about 350° C.

17. A process according to claim 10, wherein the black coating formed by the process has an areal density of from about 2.5 to about 10 grams per square meter of surface.

18. A process according to claim 10, wherein the coating formed by the process has a thickness of about 0.5 to about 4 microns.

19. A process according to claim 18, wherein the substrate surface coated is selected from the group consisting of ferrous metals and their alloys, aluminum and its alloys, zinc and its alloys, copper and its alloys, platings of these metals and alloys, ceramics, and glasses.

20. A process according to claim 10, wherein the substrate surface coated is selected from the group consisting of ferrous metals and their alloys, aluminum and its alloys, zinc and its alloys, copper and its alloys, platings of these metals and alloys, ceramics, and glasses.

* * * * *